US005600343A

United States Patent [19]

Sarrasin

[11] Patent Number: 5,600,343

[45] Date of Patent: Feb. 4, 1997

[54] MULTIPLEXED MATRIX DISPLAY SCREEN AND ITS CONTROL PROCESS

[75] Inventor: Denis Sarrasin, Sassenage, France

[73] Assignee: Commissariat a l'Energie Atomique, France

[21] Appl. No.: 430,187

[22] Filed: Apr. 27, 1995

Related U.S. Application Data

[63] Continuation of Ser. No. 150,467, Nov. 10, 1993, abandoned.

[30] Foreign Application Priority Data

Nov. 13, 1992 [FR] France ..... 92 13661

[51] Int. Cl.[6] ..... G09G 3/22

[52] U.S. Cl. ..... 345/74; 345/76

[58] Field of Search ..... 345/74, 75, 76, 345/78, 79, 204, 208; 313/309

[56] References Cited

U.S. PATENT DOCUMENTS

| | | | |
|---|---|---|---|
| 3,806,760 | 4/1974 | Shimada | 345/74 |
| 3,825,922 | 7/1974 | Ralph | 345/74 |
| 4,652,872 | 3/1987 | Fujita | 345/75 |
| 5,015,912 | 5/1991 | Spindt | 345/74 |
| 5,120,991 | 6/1992 | Takahashi | 345/204 |

FOREIGN PATENT DOCUMENTS

| | | | |
|---|---|---|---|
| 0197742 | 10/1986 | European Pat. Off. | G09G 3/36 |
| 0249954 | 8/1989 | European Pat. Off. | G09G 3/30 |

OTHER PUBLICATIONS

T. Leroux et al, "Microtips Display Addressing", Digest of Technical Papers, May, 1991.

S. Steiner et al, "High-Performance Column Driver for Gray-Scale TFEL Displays", Digest of Technical Papers, 1991.

"Display Drive Handbook", 1984, Texas Instruments, The AC Thin Film Electroluminescent Display, pp. 2–42 to 2–49.

J. P. Budin, "Principles d'adressage des ecrans matriciels" General Display Education Seminars–Visu 90.

D. Johnson, J. Hilburn, and P. Julich, Digital Circuits and Microcomputers (Englewood Cliffs: Prentice-Hall, 1979), p. 62.

M. Mano, Digital Logic and Computer Design (Englewood Cliffs: Prentice-Hall, 1979), p. 146.

Texas Instruments, "Interface Circuits Data Book", 1987. P. 3–133 to p. 3–140.

*Primary Examiner*—Steven Saras
*Assistant Examiner*—Kent Chang
*Attorney, Agent, or Firm*—Hayes, Soloway, Hennessey, Grossman & Hage, P.C.

[57] ABSTRACT

A multiplexed matrix display screen and a process for controlling same are provided. The screen has n row electrodes (10) and m column electrodes (8), which cross one another, and n control circuits (26*i*) for successively controlling the n row electrodes, with n and m being integers greater than or equal to 2. At least one control circuit for a row electrode (Li), with i being an integer such that $1<i\leq n$, is provided having means for applying to the row electrode (Li) a selection voltage during a first selection time and then a discharge potential during at least part of a second selection time of at least one other row electrode (Li+1), and for placing the row electrode Li under high impedance outside the first selection time and said part of the second selection time. Control circuits (24) for simultaneously applying to the m column electrodes during the first selection time potentials appropriate for displaying data on row Li are also provided.

6 Claims, 4 Drawing Sheets

MULTIPLEXED MATRIX DISPLAY SCREEN AND ITS CONTROL PROCESS

This is a continuation of application Ser. No. 08/150,467 filed on Nov. 10, 1993, now abandoned.

BACKGROUND OF THE INVENTION

1. Field of the Invention

The present invention relates to a multiplexed matrix display screen and to its control process. This screen makes it possible to display in black and white or colour, with or without half-tones, simple or complex images or pictures making it possible in particular to display moving pictures of the television picture type. The invention also applies to screens using an electroluminescent material or microdot cathodoluminescent screens.

2. Brief Description of the Related Prior Art

It is known that for the control of the display of images or pictures on a matrix screen, to each row and to each column of the screen is allocated an electrode and a control circuit and the screen is addressed one row at a time. For n rows, the multiplexing is of order n and the total image time T is subdivided into row time intervals T/n=T1. each of these intervals being allocated to the writing of image points or pixels of a screen row.

For the duration of a row period or time T1, the row addressed or selected by the short row scan is raised to a so-called selection potential Vls. During this time, the m columns are raised to potentials appropriate for the display of informations on the pixels of said row.

In the case of a solely black and white display, also referred to as digital display, either the potential Vc or −Vc is applied to the columns as a function of whether it is wished to respectively display black or white.

The unaddressed or unselected rows are, as a function of the screen type, either raised to a non-selection potential Vlns, or are left floating or placed under high impedance.

The invention is well suited to cathodoluminescent screens using emitting microtips of electrons supported by column electrodes which then serve as cathodes, the row electrodes resting on the column electrodes being isolated from the latter and perforated facing the microtips and then function as grids. One or more cathodoluminescent anodes are positioned facing the microtips. Generally a cathodoluminescent anode is constituted by an anodic conductor covered with a luminescent material under electron bombardment.

The article by T. Leroux et al "Microtips display addressing", SID 91, P. 437 contains a description of the operating principle of microtips cathodoluminescent screens and the manner of addressing them. In these known microtips screens, the unselected rows are raised to an imposed non-selection potential.

It is stated in the above article that one of the major disadvantages of such a screen is the electric power consumed during digital column addressing. Thus, the structure of a microtips screen leads to the appearance of a high row-column capacitance at each row selection and this can be discharged or charged at the column control voltage Vc.

The consumed capacitive power is then $P-1/2CVc^2Fm$, in which P is the consumption per $dm^2$, C is the capacitance per $dm^2$, Vc is the column modulating voltage and Fm the effective modulating frequency of the column signals.

In the particular case of the display of a uniformly grey background obtained by a time modulation method, the frequency Fm is equal to twice the scanning frequency Fl of the rows and the capacitive consumption is then at a maximum. In practice, for a capacitance of 30 $pF/mm^2$, a voltage modulated on 30 V columns and a row scanning frequency Fl or 30 kHz leads to a consumption of 8 $W/dm^2$.

ACTFEL electroluminescent screens use a fine electroluminescent material layer place between the row electrodes and the column electrodes. This type of screen is more particularly described in the article "Display Drive Handbook" 1984, Texas Instruments, "The AC Thin Film Electroluminescent Display", pp 2-43 to 2-49.

According to this article, the addressing sequence of each row is as follows:

1) During the selection time of one row, the potential of the row addressed is firstly raised to a potential $V_{neg}$, the potentials of the columns being raised, as a function of the information to be displayed, to +Vc or 0.

2) The selection time has a second phase during which the potentials of the selected row and all the columns are reduced to 0.

3) One then passes onto the addressing of the following row.

The previously selected row passes into a high impedance state HZ and the row potential is then floating.

This "floating row" principle is already widely used for the addressing of electroluminescent screens, which have electric power consumption problems similar to those of cathodoluminescent screens (cf. J. P. Budin, "Principes d'adressage des écrans matriciels" General Display Education Seminars—Visu 90).

The direct transposition of this control mode to microtips screens could be possible and interesting from the capacitive consumption standpoint. However, compared with the control mode generally used in cathodoluminescent screens (imposed row non-selection potential), it would lead to a significant luminance loss. Thus, the times during which the rows would be brought to zero would be taken on the addressing time of the selected row. However, in the particular case of microtips screens, the luminescence is directly proportional to the addressing time.

As users are requiring ever more complex screens it is necessary to be able to bring about an optimum use of the addressing times and therefore eliminate dead times.

For microtips screens, a discharge time is necessary after each row selection. Thus, in this type of screen, any voltage exceeding the threshold voltage immediately leads to the emission of electrons at the tips and therefore light at the front face (cathodoluminescence phenomenon.) However, the selection of a row takes place by raising the latter to a potential close to the threshold, the column potential translating the information to be displayed.

Thus, having imposed this potential on the first or row terminal of the row-column capacitance, if it was merely adequate to "open the switch", the potential of said row would not instantaneously vary in order to make the row unselected, but would instead very slowly return to the mean potential of the columns. Consequently by adding the column potentials intended for the following rows, there would be a succession of parasitic emissions. Multiplexing is not possible under these conditions. It is therefore absolutely necessary to discharge the row immediately after its selection time. The discharge time corresponds to the time necessary for the outflow of all the charges stored in the previously addressed row.

A single pulse having a virtually negligible duration compared with the selection time cannot be used for solving this problem. Thus, it is not sufficient to raise the row electrode to the desired potential, it also being necessary to eliminate all the charges stored in the "reservoir" constituted by the distributed charge row, formed by the row electrode (of non-zero resistivity) coupled to its system of row-column capacitances, the second terminal of said capacitances being respectively connected to a high resistance (resistive layer located between the microdots and the corresponding column electrode). In practice, the time necessary for the dissipation of the charges exceeds approximately 10 microseconds.

SUMMARY OF THE INVENTION

The present invention relates to a multiplexed matrix display screen and its control process making it possible to obviate the aforementioned disadvantage, i.e. reduce the capacitive consumption without reducing the useful addressing time.

Essentially the capacitive consumption of a matrix screen is due to charges and discharges of capacitances located between the unselected columns and rows. The non-selection instants of the rows must make no contribution to the display, so the inventors have envisaged freeing the unselected row electrodes by placing them in a high impedance state, so that no current flows between the columns and the rows. However, this is only acceptable if at all times their potential difference with the columns remains below the electron emission threshold.

Therefore the invention relates to a multiplexed matrix display screen having n row electrodes and m column electrodes in crossed manner for carrying control signals, n row control circuits for successively controlling the n row electrodes, with n and m integers $\geqq 2$, the control circuit of the row electrode Li, with i an integer an integer such that $1 \leqq i \leqq n$, having means for applying to the row electrode Li a selection potential during a first selection time and then a discharge potential during at least part of a second selection time of at least one other row electrode and for placing under high impedance the row electrode Li outside the first selection time and said part of the second selection time, column control circuits for simultaneously applying to the m column electrodes during the first selection time potentials appropriate for the display of the informations of the row Li.

The invention also relates to a matrix screen control process, characterized in that, for the n row electrodes of the screen, the following stages are successively applied:

applying to a row electrode Li, with i being an integer such that $1 \leqq i \leqq n$, a selection potential during a first selection time, followed by a discharge potential during at least part of a second selection time of at least one other row electrode and then placing the row electrode Li under high impedance outside the first selection time and said part of the second selection time and applying to the m column electrodes during the first selection time potentials appropriate for the display of information of the row Li.

The screen according to the invention permits a significant reduction of the electrical consumption as a function of the image to be displayed. It is in particular found that in the case of a transition on passing from a black row to a white row the capacitive consumption which was at a maximum in the prior art, becomes zero in a floating row and that conversely, in the case of a transition passing from a row containing the same number of black points as white points to a row of the same type, but whilst reversing each pixel, the consumption which was also at a maximum in the prior art remains unchanged.

The discharge of the selected or addressed row can simply take place by the use, at the output stage of the row control circuits, of push-pull-type circuits.

Although perfectly adapted to cathodoluminescent screens, the invention also applies to electroluminescent screens using one or more electroluminescent materials placed between the row electrodes and column electrodes e.g. of the ACTFEL type.

BRIEF DESCRIPTION OF THE DRAWINGS

The invention is described in greater detail hereinafter relative to non-limitative embodiments and with reference to the attached drawings, wherein show.

DETAILED DESCRIPTION OF PREFERRED EMBODIMENTS

Figure 1:
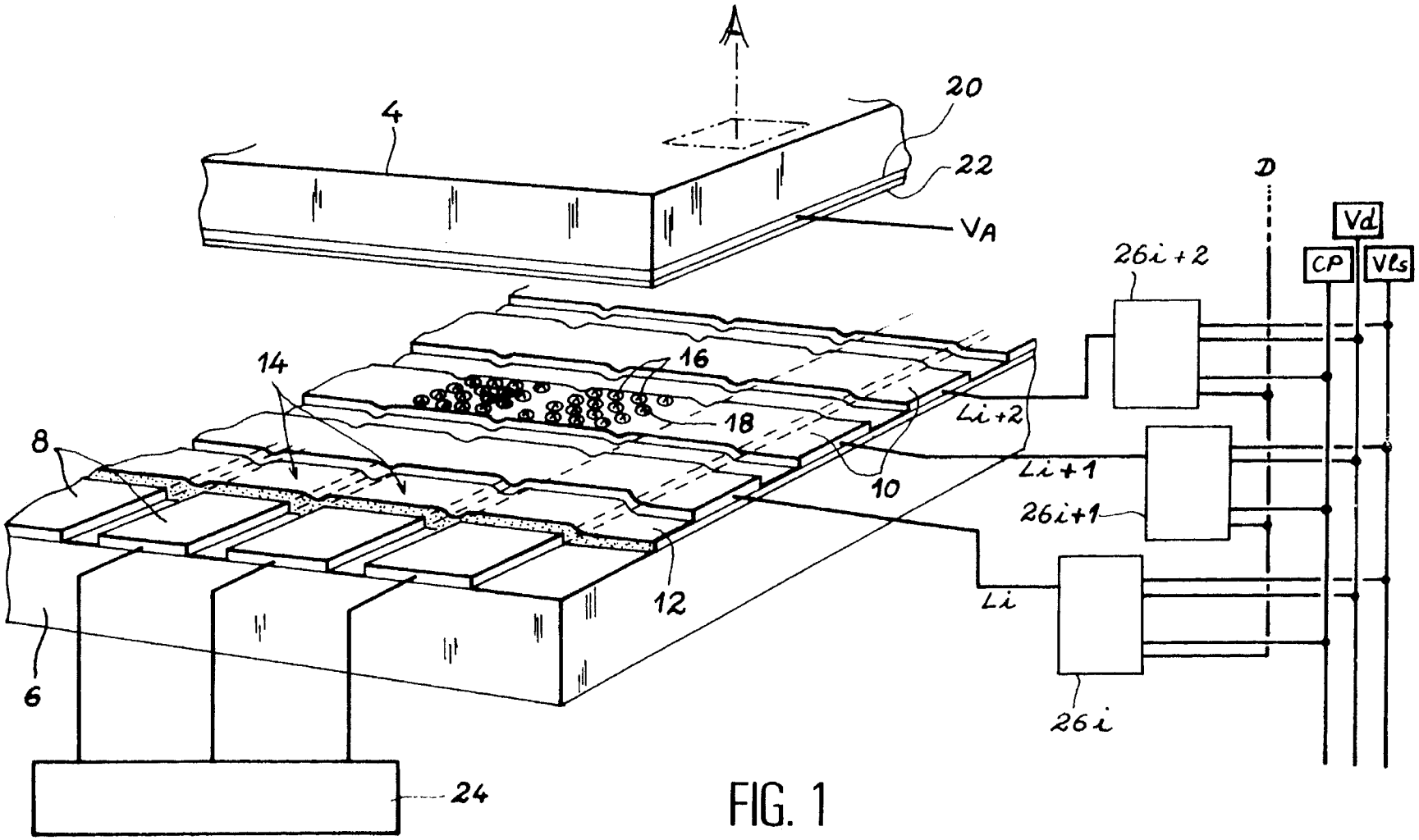
FIG. 1 is a partial, diagrammatic view of a display screen according to the invention

The display screen in FIG. 1 is a cathodoluminescent matrix screen for a black and white display. In known manner, said screen has two transparent walls 4, 6 facing one another and normally tightly assembled. The lower wall 6 is provided with parallel column electrodes 8 serving as cathodes, and parallel row electrodes 10 serving as grids placed above the column electrodes and perpendicular thereto. An electrically insulating layer 12 placed between the electrodes 8 and 10 ensures their electrical insulation.

An elementary display point or pixel 14 corresponds to each intersection of a row electrode and a column electrode.

The column electrodes 8 carry microtips 16 made from an electron emitting material at the pixels. Facing the said microtips 16, the insulating layer 12 and the row electrodes 10 have holes 18 from which the microtips emerge.

The upper wall 4 of the screen is provided with a continuous conducting layer 20 serving as the anode. The latter is covered with a layer 22 made from a light emitting material when exposed to an electron bombardment from the microtips 16.

The emission of electrons by the microtips 16 takes place by simultaneously polarizing the cathodes 8, the grids 10 and the anode 20. The anode is raided to the highest potential VA (generally between 200 and 600 V) and the cathodes 8 are simultaneously controlled at each row addressing with the aid of a known control circuit 24.

Figure 2:
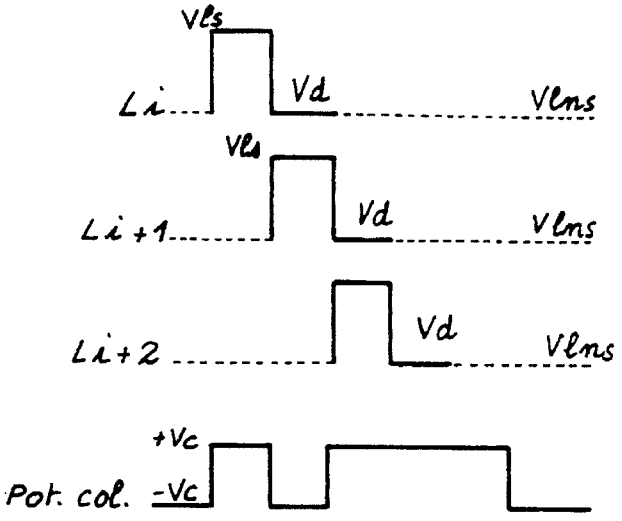
FIG. 2 shows different signals applied to the rows and columns of the screen according to the invention.

Said circuit 24 supplies a voltage +Vc or −Vc, as shown in FIG. 2, in the case of a black and white display, the potential +Vc being used for the display of a black dot or point, whereas the potential −Vc is used for the display of a white dot or point. In the case of a display with several grey levels or the like, it is possible to use the signals described in the aforementioned document by T. Leroux et al.

The originality of the invention is based on the row control circuit of said screen, the remainder being in accordance with the prior art. The general synoptics of the row control circuit of the screen are also shown in FIG. 1.

With each row electrode Li (in which i is an integer from 1 to n if n is the total number of row electrodes) corresponds a control circuit 26*i* connected to a clock CP for the sequential addressing of the rows, to an electric power supply supplying a row selection potential VLs and to an electric power supply supplying a row discharge potential Vd.

According to the invention application takes place during the selection time of the row Li of the selection potential VLs shown in FIG. 2. During this selection time, application takes place to the columns of potentials appropriate for the display of informations on the row Li, namely the potential −Vc or +Vc as a function of whether it is wished to display an illuminated state or an extinguished state on the pixels of the row Li.

This is followed by the discharge of the previously selected row Li by raising it to the discharge potential Vd. This discharge potential Vd is ≦−Vc. It is applied to the row Li during at least part of the selection time of the row Li+1 and therefore the application of the selection voltage VLS to said row Li+1.

FIG. 2 shows a potential Vd applied throughout the selection time of the row Li+1.

Following the discharge of the row Li, the latter is placed under high impedance (HZ) during the entire non-selection time of the row Li. The non-selection potential Vlns is fixed by capacitive coupling with the columns and can therefore vary according to the proportion of ignited pixels of the selected row.

From the standpoint of the timing diagram (FIG. 2), it can be seen that in the invention the discharge of the previously selected row Li takes place in "masked" time during the selection of the current line Li+1. Therefore, the luminescence of the screen is equivalent to that obtained with an imposed potential row return.

Figure 3:
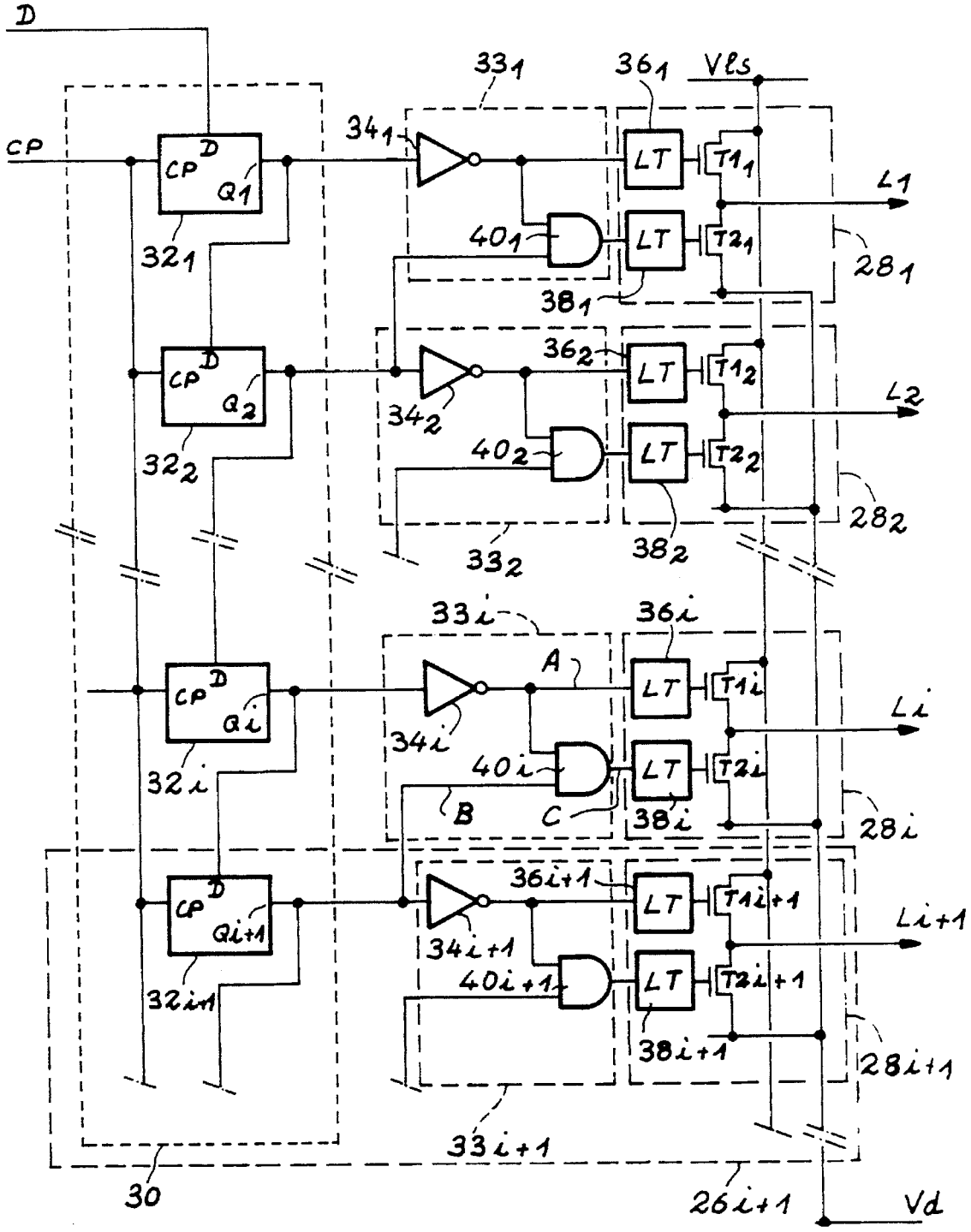
FIG. 3 shows an embodiment of the row control circuits of the screen according to the invention.

The control circuits 26*l*–26*n* must be able to impose a positive selection potential Vls or discharge potential Vd to the addressed rows and then a high impedance state HZ. As shown in FIG. 3, this can be obtained with the aid of an output stage 28*i* incorporating (for each circuit 26*i*) a conventional push-pull circuit, which can be produced with the aid of bipolar or MOS transistors and logic means for controlling said transistors.

The two transistors of the push-pull system 28*i* of the row Li are designated T1*i* and T2*i*. T1*i* is connected on the one hand to a power supply able to supply the selection potential Vls and on the other hand to T2*i* and to the row Li and T2*i* is also connected to a power supply able to supply the discharge potential Vd.

The selection of the row Li takes place by opening the transistor T2*i* and closing the transistor T1*i*. The discharge of the row Li takes place by opening the transistor T1*i*. The discharge of the row Li takes place by opening the transistor T1*i* and closing the transistor T2*i*. Placing under high impedance is carried out by simultaneously opening the transistors T1*i* and T2*i* of the row Li.

This type of control can be achieved with the aid of an input circuit of the shift register 30 type having n+1 flip-flops 32*l*–32*n*+1 for controlling the n output circuits 28*l* to 28*n* of the n rows of the screen.

According to the invention, the shift register 30 has a series data input D, a clock input CP and n+1 parallel outputs Q1–Qn+1. The rank i flip-flop 32*i* is connected across an inverter 34*i* and a first level translator 36*i* to the transistor T1*i*, whilst the transistor T2*i* is connected, either directly, or across a second level translator 38*i* to the rank i+1 flip-flop and therefore to the output Qi+1 of the flip-flop 32*i*+1.

In addition, the register must have one stage more than the number of row output circuits. This stage located at the end or the shift register makes it possible to complete the control of the last output circuit.

In practice, it is necessary to be able to guarantee the non-simultaneous conduction of the transistors T1*i* and T2*i* no matter what the states of the flip-flops. A possible way of achieving this result is the addition of an "AND" gate 40*i* having for its inputs the output of the rank i flip-flop and the output of the rank i+1 flip-flop and thus acting as a validation for the translator 38*i* of the transistor T2*i*.

For each rising front of the clock CP, the information present on the input D of the shift register 30 is charged into the first position of the register (or first flip-flop) and all the data contained in the register are shifted from one flip-flop to the other. Working takes place at the start of the frame or image by positioning a logic level "1" on D and then a logic level "0" for all the following clock strokes. Thus, this leads to the circulation of a single state "1" in all the positions of the register corresponding to the successive selection of all the screen rows.

In view of the fact that the data of the shift register 30 correspond to "1" for the selected row and to "0" for the unselected rows, use is advantageously taken of an inverter 34*i* between the stage 32*l* and the transistor T1*i*, although obviously other logic circuit can be used for controlling the transistors. In the same way it would be possible to us a logic "0" for the selected row and a logic "1" for the unselected rows and therefore logic means adapted to this transistor control type.

The presence of a logic "1" on the output Qi of the flip-flop 32*i* imposes a logic "0" after the associated inverter 34*i* and the first level translator 36*i* raises the grid of the transistor T1*i* to a potential Vls–Vth such that it permits the conduction of the transistor (switch 28*i* closed on Vls: row Li to Vls), in which Vth is a grid-source voltage higher than the conduction threshold of the control transistor T1*i*.

During the same time, the logic level "1" of the flip-flop 32*i* of rank i is applied to the "AND" gate 40*i*-1 of the stage of rank (i-1) of the register, the flip-flop 32*i*-1 being normally at zero. There is a logic "1" following its inverter 34*i*-1 and in front of the second input of the "AND" gate 40*i*-1, which thus transmits a logic "1" to the voltage translator 38*i*-1 of the transistor T2*i*-1, thus imposing on the grid of said transistor a voltage Vd+Vth such that it permits the conduction of the transistor T2*i*-1 (switch 28*i* closed on Vd: row Li−1 to Vd).

Moreover, the "AND" gate 40*i* validating the transistor T2*i* imposes a logic "0" level for said transistor and the voltage translator 38*i* thus imposes on the grid of the transistor T2*i* the voltage Vd, which blocks the transistor T2*i* (switch 28*i* open, the stage of the row Li not being imposed by the transistor T2*i*).

The following clock pulse on the input CP of the register 30 shifts the logic level "1" from the flip-flop 32*i* to the flip-flop 32*i*+1 and a "0" state is obtained on the output Qi of the flip-flop 32*i*, a further clock pulse shifting the data. There are then logic "0" levels on the outputs Qi and Qi+1 of the flip-flops 32*i* and 32*i*+1 and so on. The overall behaviour is summarized in the following table for flip-flop 32*i*.

| Time Index | j − 1 | j | j + 1 | j + 2 |
|---|---|---|---|---|
| Qi | 0 | 1 | 0 | 0 |
| A | 1 | 0 | 1 | 1 |
| B | 0 | 0 | 1 | 0 |
| C | 0 | 0 | 1 | 0 |
| G1 grid of T1i | Vls | Vls − Vth | Vls | Vls |
| G2 grid of T2i | Vd | Vd | Vd + Vth | Vd |
| T1i | open | closed | open | open |
| T2i | open | open | closed | closed |
| Row Li output | HZ | Vls | Vd | HZ |

Tj corresponds to the time which elapses between two clock strokes CP with j between 1 and n and A, C respectively represent the inputs of the translators 36*i* and 38*i* of the output circuit 28*i*, whilst B represents the input of the AND gate 40*i* connected to the flip-flop 32*i*+1.

If the discharge voltage Vd is equal to the "logic earth" of the circuit, the rank i+1 output of the register 30 is effectively directly connected to the grid of the transistor T2 via the "AND" gate 40*i* (to within a time lag produced by conventional means, intended to prevent the simultaneous conduction of the two transistors T1*i* and T2*i* of the output stage i). In the opposite case, a logic level translation stage 38*i* must be inserted.

It is sometimes of interest to address the rows in such a way that firstly one part (i=2, 4, 6 etc.) and then the other (i=1, 3, 5, etc.) is scanned. This configuration obviously applies in the case of an interlaced video source, but can also be less disadvantageous from the electric power consumption standpoint for the display of certain types of pictures (e.g. stipple grey).

Figure 4:
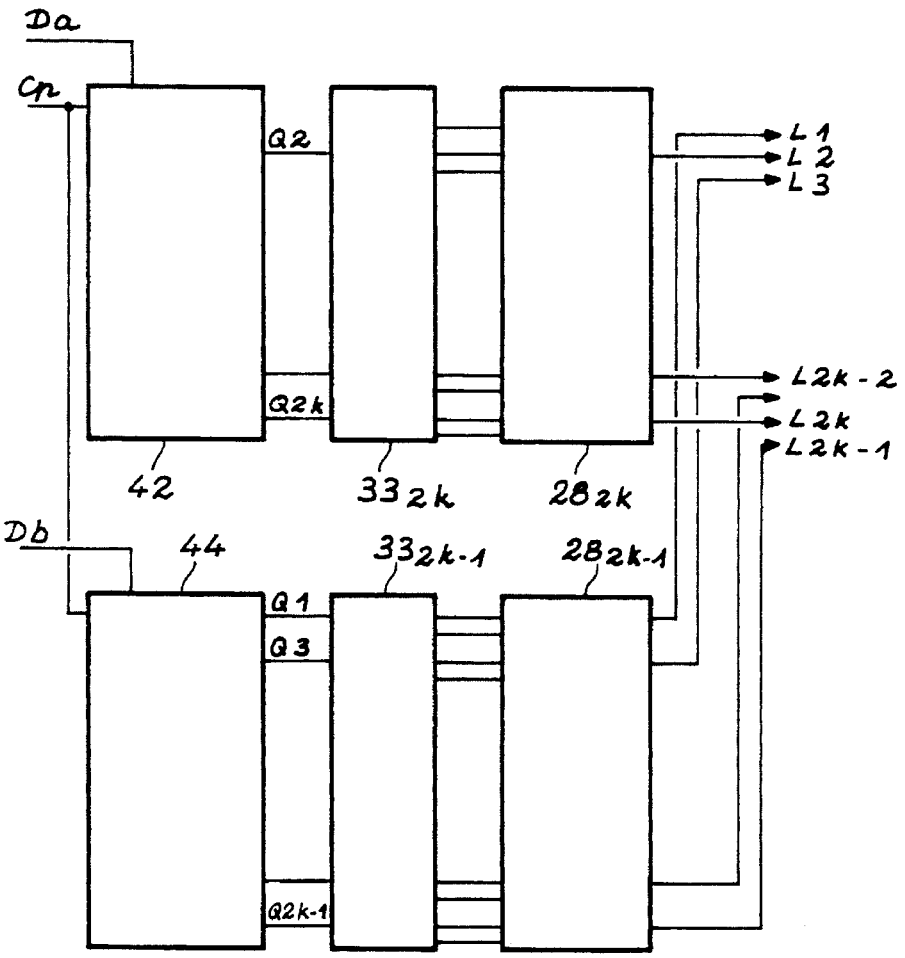
FIG. 4 shows a variant of the row control circuits of the screen according to the invention.

The practical realization of such a scan, on the basis of the previously described circuit shown in FIG. 4, takes place using two half-shift registers 42, 44, each having a data input Da and Db. The outputs Q2–Q2*k* and Q1–Q2*k*–*1* respectively of said half-registers 42, 44 remain coupled to their output stages, but said outputs, namely those from even registers and those from the uneven registers, must be interlaced.

Under these conditions, the half-shift register 42 is associated with the combinational logic $\mathbf{33}_{2k}$ (inverters and AND gates) and the output circuits ($\mathbf{28}_{2k}$) incorporating push-pull circuits associated with the rows 2*k* (in which k assumes values from 1 to n/2). In the same way, the half-register 44 is associated with the combinational logic $\mathbf{33}_{2k-1}$ (inverters and AND gates) and the output circuits $\mathbf{28}_{2k-1}$ of the rows $L_{2k-1}$.

The preceding description corresponded to a discharge time of the row Li equal to the selection time of the row Li+1. However, according to the invention, it is also possible to use a discharge time different from that of the selection time of the following row.

Figure 5:
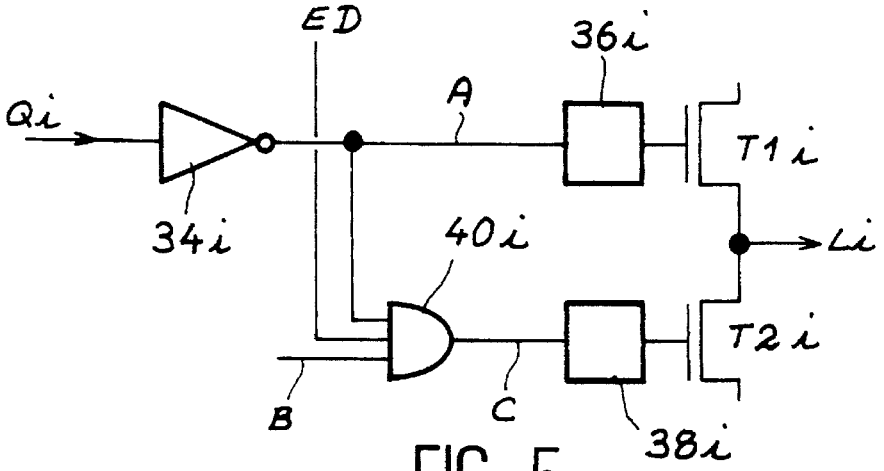
FIGS. 5 and 6 show variants of the input circuit of each control circuit of a row according to the invention.
Figure 6:
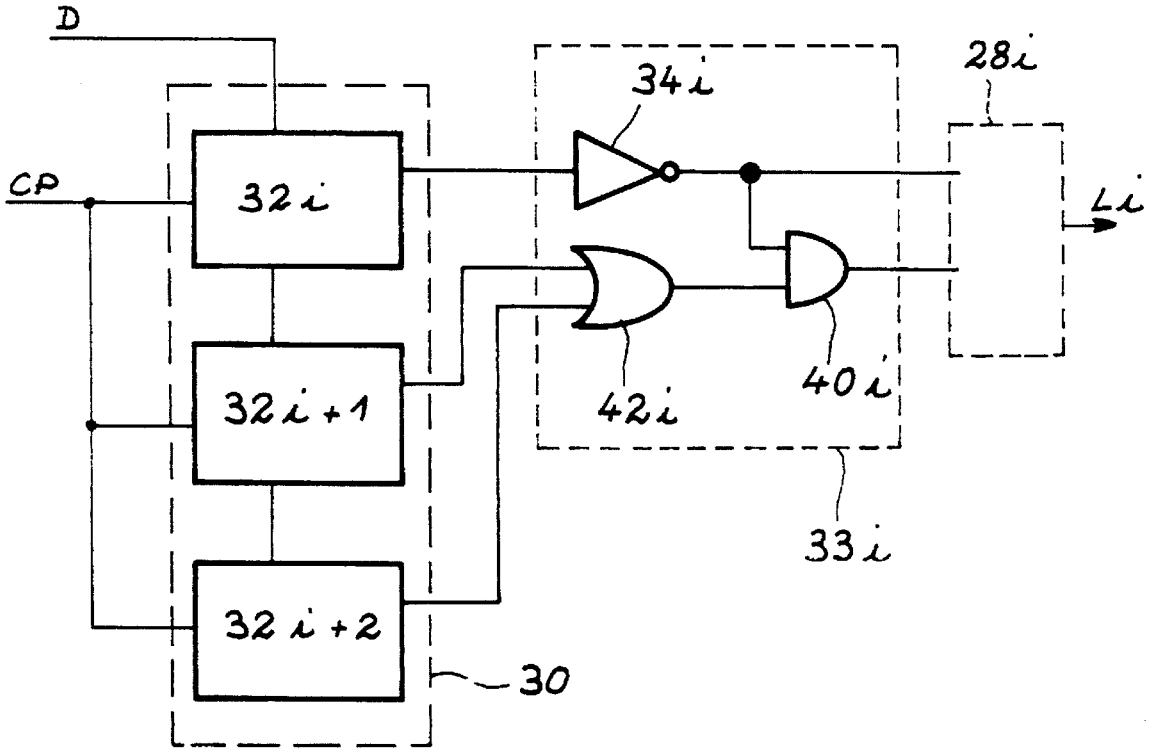

FIGS. 5 and 6 respectively show a modification of the combinational logic of FIGS. 3 and 4 in the case of a discharge time of the row Li shorter than the selection time of the following row and in the case of a time longer than the selection time of the following row.

For a shorter time, a signal ED is applied and this operates in an identical manner on all the gates 40*i*. This signal applied sequentially to the rows Li validates the discharge time and thus makes it possible to adjust its duration between 0 and the selection time of the following row.

Thus, compared with the diagram of FIG. 3, the input point C of the translator 38*i* can only be at 1, which imposes conduction of the transistor T2*i* and therefore discharge, if the signal ED is also at 1.

The cathodoluminescent or other screens requiring discharge times longer than the row selection time, it would be possible to use a variant of the logic circuit which would make it possible to validate, for the discharge of a row, the selection times of several following rows. This can be obtained by using a logic OR 42*i* for the row Li, placed in front of the input B of the gate 40*i* and connected to several output stages 32*i*+1, 32*i*+2 e.g. of the shift register 30.

The proposed control mode obviously applies in the case of the display with grey levels (no matter whether this is of a digital or analog type). Different grey shades can be obtained by modulating the duration and amplitude of the column signals. In order to avoid parasitic light emissions, it is necessary that $V_d$ remains the lowest voltage used.

Compared with an addressing with imposed row non-selection potential, it can be seen that the row voltage excursion must be large, because it must completely cover the column excursion (i.e. Vd≦−Vc and Vls≦Vs+Vc, Vs corresponding to an ϵ close to the emission threshold).

The application to colour is obvious and causes no specific problem. Thus, the trichromatic system is obtained either by a successive scanning of the three colours (red, green and blue) by anode voltage multiplexing, or by tripling the cathode controls. Therefore it has not specific affect on the row scanning mode. In particular, it is possible to use the system of three anodes per pixel respectively for red, green and blue with connection of the anodes of the same colour to one another and the control process of said anodes is in accordance with EP-A-349 425.

I claim:

1. A multiplexed matrix display screen comprising n row electrodes (10) and m column electrodes (8) in crossed manner for carrying control signals, n row control circuits (26*i*) for successively controlling the n row electrodes, with n and m being integers ≧2, the control circuit of the row electrode Li, with i being an integer such that 1≦i≦n, having means for applying to the row electrode Li a selection potential (Vls) during a first selection time T1 and then a discharge potential (Vd) during at least part of a second selection time of at least one other row electrode (Li+1) and for placing under high impedance the row electrode Li outside the first selection time and said part of the second selection time, the discharge potential (Vd) applied to the row electrode (Li) and a selection potential (Vls) applied to the said other row electrode (Li+1) being initiated simultaneously so as to permit said screen to have a total image time T equal to n times T1, and column control circuits (24) for simultaneously applying to the m column electrodes during the first selection time potentials (−Vc, +Vc) for display of data of the row Li, the discharge potential (Vd) being below the smallest potential (−Vc) applied to the column electrodes, and wherein said multiplexed matrix display screen further comprises at least one cathodoluminescent anode (20), electrode emitting microtips (16) supported by column electrodes, the row electrodes resting on the column electrodes and being insulated therefrom and having holes from which the microtips emerge, and also wherein said means for applying said selection potential and said discharge potential, and for placing under high impedance said low electrodes includes an input circuit comprising a shift register with n+1 flip-flops for controlling the n output circuits, a push-pull circuit with at least two logic inputs and one output, said push-pull circuit being connected to said selection and discharge potentials, and said tow logic inputs being connected to combinatorial logic.

2. A screen according to claim 1, wherein said at least one means has an output circuit comprising said push-pull circuit (28*i*), said push-pull circuit being directly connected to the row electrode (Li), to a power supply for supplying the selection potential (Vls) and to a power supply for supplying the discharge potential (Vd).

3. A screen according to claim 1, wherein said means for applying includes "AND" gates (40*i*) connected between the input circuit (30) and each output circuit (28).

4. A screen according to claim 1, wherein said means for applying includes an "OR" circuit (42*i*) between the input circuit (30) and each output circuit (28*i*), so that the discharge potential is applied to the row Li for a time exceeding the selection time of a row.

5. A screen according to claim 1, and further comprising at least one voltage level translator circuit (36*i*, 38*i*) provided in each output circuit (28*i*).

6. A process for control of a multiplexed matrix display screen having n row electrodes (Li) and m column electrodes (8), with electron emitting microtips, in crossed manner for carrying control signals, in which the n rows (Li) are successively selected, n and m being integers $\geqq 2$, wherein the following steps are successively performed for the n row electrodes of the screen:

applying to the row electrode Li, with i being an integer such that $1 \leqq i \leqq n$, a selection potential (Vls) for a first selection time T1 followed by a discharge potential (Vd) during at least part of a second selection time of at least another row electrode (Li+1), and then placing the row electrode Li under high impedance outside the first selection time and said part of the second selection time, the discharge potential (Vd) applied to the row electrode (Li) and a selection potential (Vls) applied to the said other row electrode (Li+1) being initiated simultaneously so as to permit said screen to have a total image time T equal to n times T1, said discharge potential (Vd) being below the smallest potential (−Vc) applied to the column electrodes, and applying the m column electrodes (8) during the first selection time potentials (+Vc, −Vc) for displaying data of the row Li, and wherein at least one potential selected from the group consisting of said selection potential and said discharge potential, is applied, and said row electrodes are placed under high impedance, by means including an input circuit comprising a shift register with n+1 flip-flops for controlling the n output circuits, a push-pull circuit having at least two logic inputs and one output, said push-pull circuit being connected to the selection and discharge potentials, and said at least two logic inputs are connected to combinatorial logic.

* * * * *

UNITED STATES PATENT AND TRADEMARK OFFICE

CERTIFICATE OF CORRECTION

PATENT NO. : 5,600,343

DATED : February 4, 1997

INVENTOR(S) : Denis Sarrasin

It is certified that error appears in the above-indentified patent and that said Letters Patent is hereby corrected as shown below:

Claim 1, Col. 8, Line 59, "low" should be --row--.
Claim 6, Col. 10, Line 11, insert --to-- after "applying".

Signed and Sealed this

Sixth Day of May, 1997

*Attest:*

Bruce Lehman

BRUCE LEHMAN

*Attesting Officer*

*Commissioner of Patents and Trademarks*